US006685026B1

(12) United States Patent
Hanna

(10) Patent No.: US 6,685,026 B1
(45) Date of Patent: Feb. 3, 2004

(54) ONE-PIECE CONTAINER WITH INTEGRAL INTERNAL CUSHIONING SUPPORTS

(75) Inventor: David M. Hanna, Augusta, MI (US)

(73) Assignee: Arvco Container Corporation, Kalamazoo, MI (US)

( * ) Notice: Subject to any disclaimer, the term of this patent is extended or adjusted under 35 U.S.C. 154(b) by 508 days.

(21) Appl. No.: 09/710,407

(22) Filed: Nov. 9, 2000

(51) Int. Cl.[7] ..... B65D 85/30

(52) U.S. Cl. ..... 206/586; 206/454; 206/592; 229/120.21

(58) Field of Search ..... 206/521, 586, 206/591–594, 449, 453, 454, 456; 229/120.17, 120.13, 120.21, 167

(56) References Cited

U.S. PATENT DOCUMENTS

| | | | | |
|---|---|---|---|---|
| 1,069,021 A | | 7/1913 | Miller | |
| 2,294,641 A | | 9/1942 | Walters | |
| 2,684,758 A | | 7/1954 | Aquino | |
| 2,967,009 A | | 1/1961 | Lidgard | |
| 3,211,282 A | * | 10/1965 | Hennessey | 206/449 |
| 3,240,417 A | | 3/1966 | Andreini | |
| 3,790,065 A | | 2/1974 | Carpenter | |
| 3,791,571 A | | 2/1974 | Pilz, III | |
| 4,211,356 A | * | 7/1980 | Tsuchiya et al. | 206/592 |
| 4,438,848 A | * | 3/1984 | Montealegre et al. | 229/120.21 |
| 5,145,070 A | * | 9/1992 | Pallett et al. | 206/592 |
| 5,322,168 A | | 6/1994 | Kataoka | |
| 5,372,259 A | * | 12/1994 | Suzuki et al. | 206/592 |
| 5,544,806 A | | 8/1996 | Anderson et al. | |
| 5,803,267 A | | 9/1998 | Tu et al. | |
| 5,871,147 A | * | 2/1999 | Smith et al. | 229/120.17 |
| 6,092,651 A | * | 7/2000 | Miller | 206/521 |
| 6,095,408 A | * | 8/2000 | Nguyen | 229/120.21 |

FOREIGN PATENT DOCUMENTS

| | | |
|---|---|---|
| DE | 26 36 454 | 2/1978 |

* cited by examiner

*Primary Examiner*—Luan K. Bui
(74) *Attorney, Agent, or Firm*—Flynn, Thiel, Boutell & Tanis, P.C.

(57) ABSTRACT

A container which is formed from a one-piece blank so as to define a pair of side wall structures which support a fragile article in spaced relation from all external sides of the container. The side wall structures are folded so as to form generally tubular configurations which define respective elongate channels disposed in opposed relation with one another on opposite sides of the container. Opposite edges of the article are inserted into the respective channels so as to be spaced from the top, bottom and all sides of the container to provide protection against impact, for example during storage or transport.

17 Claims, 6 Drawing Sheets

ONE-PIECE CONTAINER WITH INTEGRAL INTERNAL CUSHIONING SUPPORTS

FIELD OF THE INVENTION

This invention relates to an improved shipping container which is assembled from a foldable blank and designed specifically for transporting fragile articles, such as framed pictures or the like.

BACKGROUND OF THE INVENTION

Many types of boxes or cartons are commercially employed for the storage and shipment of fragile articles, such as framed pictures, mirrors, or even sensitive electronic equipment, and are typically constructed of corrugated paperboard. These boxes are often provided therein with various kinds of cushioning materials and restraints in order to limit or prevent movement of the objects in the box to protect them from damage. It is also known to place separate corrugated inserts in corrugated board containers for the same purpose. However, these packaging techniques are less than satisfactory because several different manufacturing steps are required to provide the different components that make up the total container. Further, the shipment, storage and inventory of the different components is relatively difficult and the assembly operation is more complex and expensive than is desired.

Accordingly, shipping containers have been developed which are of a one-piece construction and are foldable from a corrugated blank to form a complete enclosed container. The folding of the blank forms internal cushioning structures which accommodate the article being stored or shipped. These types of containers support the article in spaced relation from the sides of the container so as to prevent injuries which can be caused by sidewardly directed impacts occurring during transport. For example, U.S. Pat. Nos. 3,790,065 and 3,791,571 each disclose one-piece blanks which are foldable into a cushioned package so as to define a cavity for a flat object, such as a book. The packages disclosed in these patents are foldable to form cushioning wall structures which support the ends of the object in inwardly-spaced relation from the external sides of the container to protect the object during shipping. However, these packages do not provide cushioning protection on all sides of the object, such as on the top and bottom thereof, which can lead to damage in the event of impacts.

Further, U.S. Pat. Nos. 5,145,070 (owned by the same assignee hereof) and 5,372,259 disclose containers, each formed from a one-piece blank which is foldable to define interior cushioning structures for supporting the object stored within the container in spaced relation from all external sides thereof. However, the cushioning structures are more complex than desired, such as requiring opposed foldable flaps for supporting one end of an object, and hence require increased assembly time and expense.

It is thus an object of the invention to provide an improved container formed from a one-piece blank which is foldable into a closed configuration and defines internal tubular support or cushioning structures at opposite ends of the container. The support structures in turn define therein elongate channels for receiving an end of the article being stored or transported and for restraining movement of the article to protect same from damage.

More specifically, the improved container, in accordance with one aspect of the invention, relates to a one-piece container constructed from a one-piece blank of corrugated material. The container includes a horizontally enlarged and generally planar bottom wall, and first and second elongate upright side walls folded upwardly from the bottom wall about fold lines which extend along respective side edges thereof. A horizontally enlarged top wall is integrally joined to one of the side walls and is pivotable with respect thereto between open and closed positions, and third and fourth elongate side wall structures are disposed in opposed spaced-apart relation with one another and extend transversely with respect to the first and second side walls. These side wall structures are each formed by a single flap integrally joined to the bottom wall and folded upwardly therefrom about a fold line which extends along one of the respective side edges thereof. Each of the flaps are foldable to define an outer wall which forms part of the external surface of the container and a plurality of support surfaces which together define a channel which opens generally sidewardly and inwardly. The channels of the opposed third and fourth side wall structures together define a pocket for receiving a generally plate-like article therein, and the support surfaces maintain the article in spaced relation from the top and bottom walls, the outer walls and the first and second side walls to prevent damage to the article during storage or transport thereof.

The invention also relates to a box including a generally planar bottom wall, first and second elongate and opposed side walls projecting generally upwardly from the bottom wall generally along one pair of side edges thereof, and third and fourth elongate and opposed end walls extending transversely relative to the first and second side walls and projecting generally upwardly from the bottom wall generally along another pair of side edges thereof. A top wall is disposed in generally parallel relation with the bottom wall and is spaced upwardly therefrom by the side and end walls. The box has a width dimension as defined between either pair of the opposed side and end walls which is significantly greater than a depth dimension as defined between the top and bottom walls so as to accommodate a generally planar, plate-like object therein. Further, a pair of elongate support structures are respectively positioned along the pair of opposed end walls in spaced-apart relation with one another, with each support structure defining a channel therein. The channels open inwardly towards one another for receiving opposite terminal edges of the object, and each support structure defines an air cushion which surrounds the edge of the object disposed within the respective channel so as space same inwardly of the top, bottom, side and end walls.

Other objects and purposes of the invention will be apparent to persons familiar with arrangements of this general type upon reading the following specification and inspecting the accompanying drawings.

Figure 1:
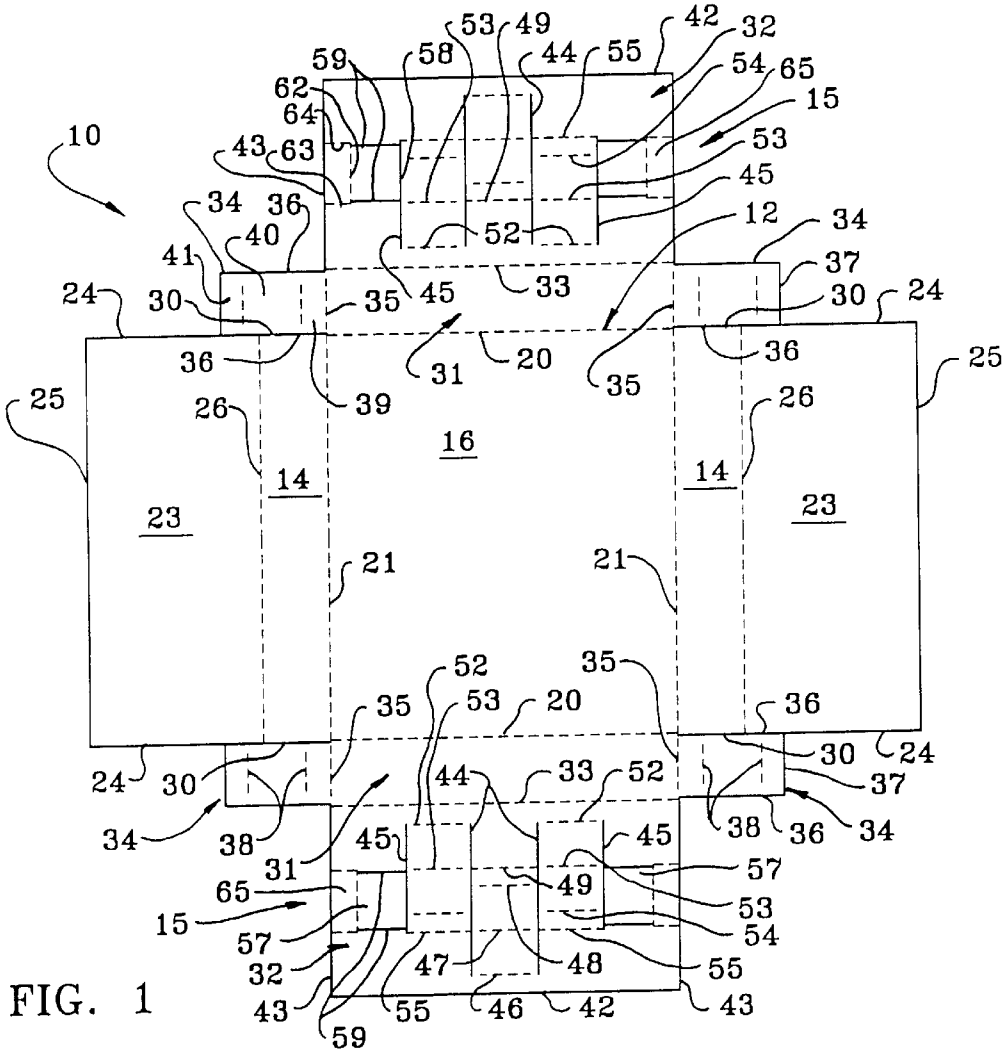
FIG. 1 is a plan view of an unfolded flat one-piece blank used for preparing the container according to the present invention.
Figure 2:
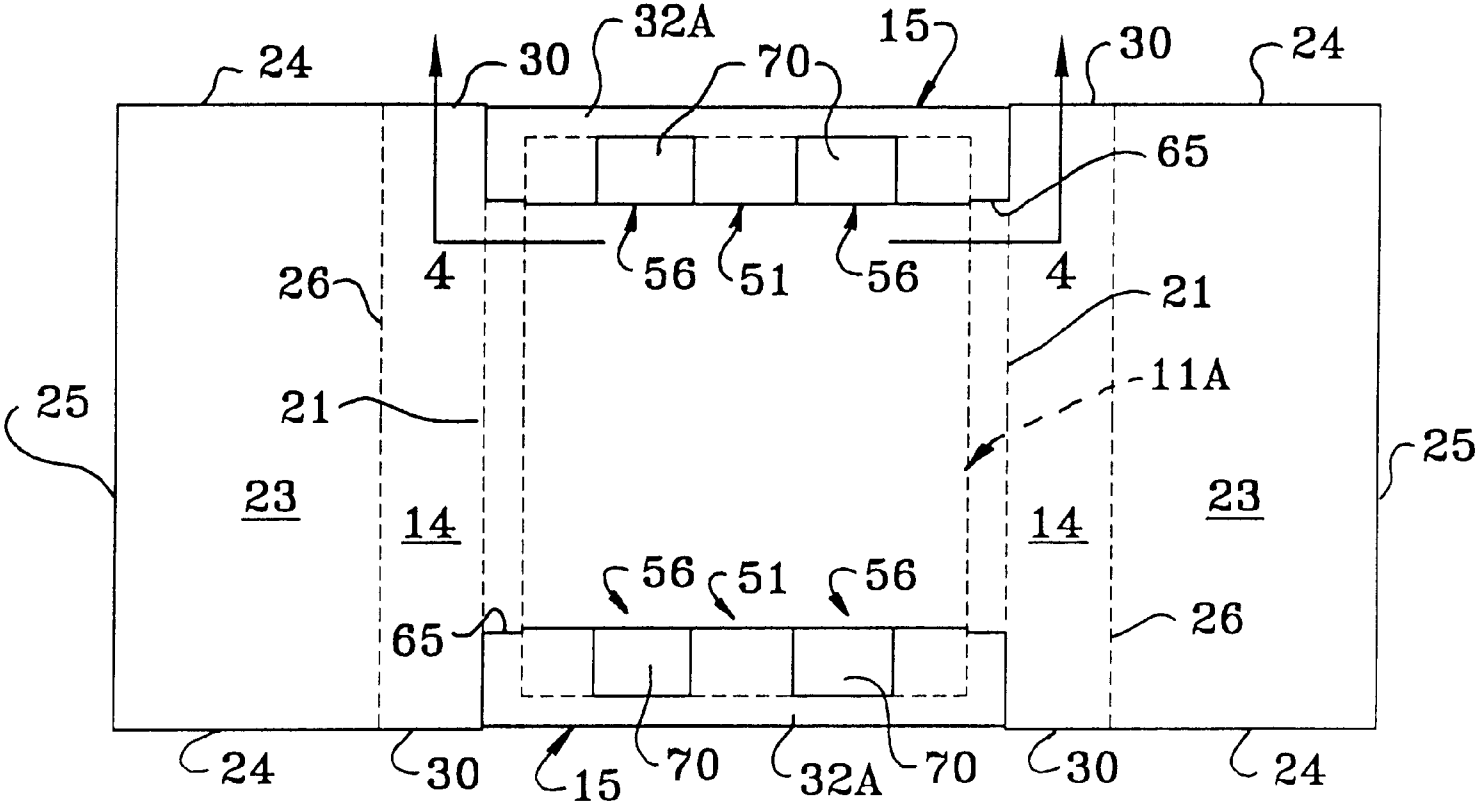
FIG. 2 is a plan view of the container formed from the blank of FIG. 1 in an open configuration with the article positioned therein and shown in dotted lines.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the container and designated parts thereof. Said terminology will include the words specifically mentioned, derivatives thereof, and words of similar import.

DETAILED DESCRIPTION

Referring to FIG. 1, the present invention is directed to a flat blank 10 which in the illustrated embodiment is constructed of stiff double-faced corrugated cardboard having a corrugated interior layer bonded between a pair of flat facing layers, which layers are of all rather thin paper or fiberboard. The blank 10 is prepared using techniques which are conventional and well known in the box forming industry.

Figure 3:
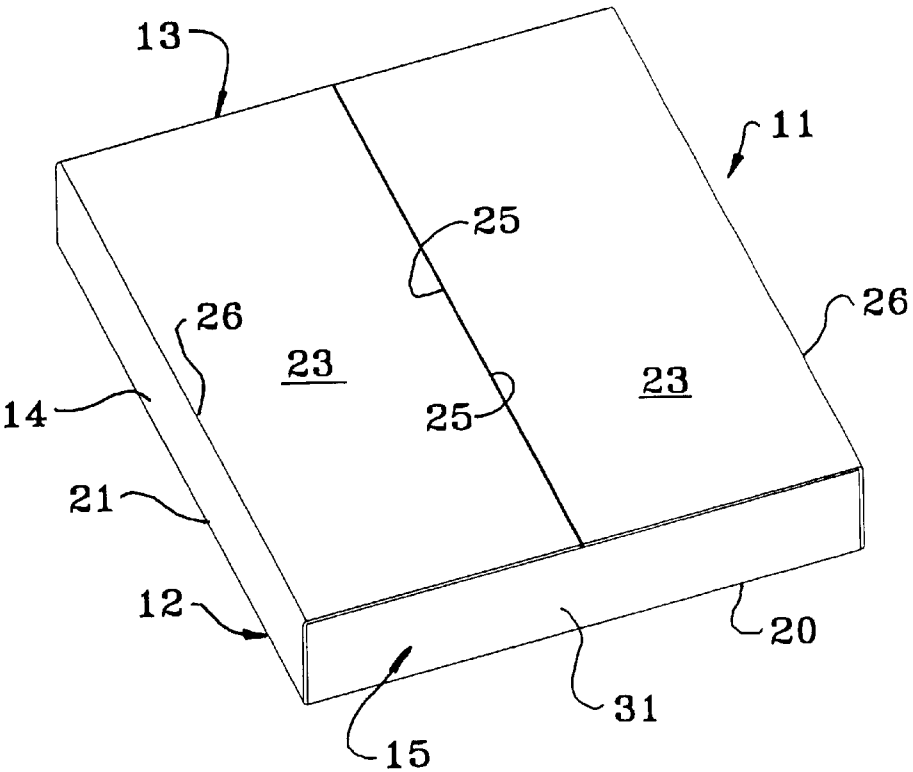
FIG. 3 is a perspective view of the container in a closed configuration for shipping or storage.

The blank 10 is foldable into the shape of a box or container 11 (FIG. 3) suitable for storing or transporting an object 11A (shown in dotted lines in FIGS. 2, 4 and 6–8), such as a framed or unframed picture, mirror, or other relatively fragile and plate-like article, which typically requires careful packing so as to avoid damage thereto. The container 11 includes a bottom part or base 12 and a top part 13 which are joined to one another by side walls 14 integrally connected to top and bottom parts 12 and 13. Container 11 also includes an additional pair of side walls 15 which are oriented transversely relative to side walls 14 and are foldable to form protective tubular cushioning structures as discussed further below.

The blank 10 (FIG. 1) is a flat and generally planar, monolithic, one-piece element and defines a bottom wall 16 which forms part of bottom part 12 and has a generally rectangular shape. The bottom wall 16 includes a pair of generally parallel first side edges 20 and a pair of generally parallel second side edges 21, the latter extending generally perpendicularly between the side edges 20. All of the side edges 20 and 21 are defined by fold lines shown in dotted lines in FIG. 1.

The top part 13 of the blank 10 is embodied by two flaps 23, each of a generally rectangular configuration. Flaps 23 are each defined by a pair of generally parallel free side edges 24, a longitudinal free side edge 25 which extends generally perpendicularly between the respective side edges 24, and an inner side edge 26 defined by a fold line which joins the flap 23 to a respective side wall 14.

Side walls 14 each include a pair of free side edges 30, which extend generally perpendicularly between fold lines 21 and 26 and are aligned with (or formed from the same cut line as) the respective side edges 24 of top flap 23.

With continued reference to FIG. 1, side walls 15 are embodied by first and second side wall parts 31 and 32. The side wall parts 31 and 32 are joined to one another through a longitudinal fold line 33 which is generally parallel to the adjacent first side edge or fold line 20 of bottom wall 16. A pair of reinforcing end flaps 34 are joined to respective opposite side edges or fold lines 35 of each side wall part 31. Fold lines 35 are parallel to one another and extend perpendicularly between fold lines 20 and 33. Each of the end flaps 34 are further defined by a pair of parallel longitudinal inner and outer free edges 36. The inner free edge 36 of each flap 34 is disposed closely adjacent the respective side edges 30 and 24 of side wall 14 and top flap 23 and is formed by the same cut line. Each flap 34 additionally includes an outer free end edge 37 which extends perpendicularly between inner and outer edges 36, and a pair of fold lines 38 parallel to and spaced inwardly from outer end edge 37. Fold lines 38 divide the respective end flap 34 into three sections once folded, namely an inner section 39, an intermediate section 40, and an outer section 41.

Each second side wall part 32 is defined by a free longitudinal side edge 42, and a pair of parallel free side edges 43 which extend perpendicularly between fold line 33 and side edge 42. Four parallel cut lines are oriented transversely between the fold line 33 and longitudinal side edge 42 of each second side wall part 32. More specifically, a pair of central cut lines 44 parallel to free side edges 43 are oriented between a pair of outer cut lines 45 spaced inwardly from and parallel to side edges 43. All of the cut lines 44 and 45 terminate short of both fold line 33 and the opposite free side edge 42, and all terminate at equal distances outwardly from fold line 33. The central cut lines 44 extend a further distance toward free side edge 42 than outer cut lines 45, and cut lines 45 terminate at equal distances inwardly from edge 42. A fold line 46 extends perpendicularly between these terminal ends of the respective central cut lines 44 and is spaced inwardly from and parallel to edge 42. Additional fold lines 47, 48 and 49 extend perpendicularly between central cut lines 44. Fold lines 47–49 are spaced from and parallel to one another and to fold line 46. Further, fold line 49 is spaced outwardly of the terminal ends of central cut lines 44 positioned adjacent fold line 33, and fold lines 47 and 48 are located between inner and outer fold lines 49 and 46. When side wall 15 is folded, the central cut lines 44 and the respective fold lines 46–49 together form a central cavity defining support 51 (FIGS. 4 and 5) as discussed below.

Figure 4:
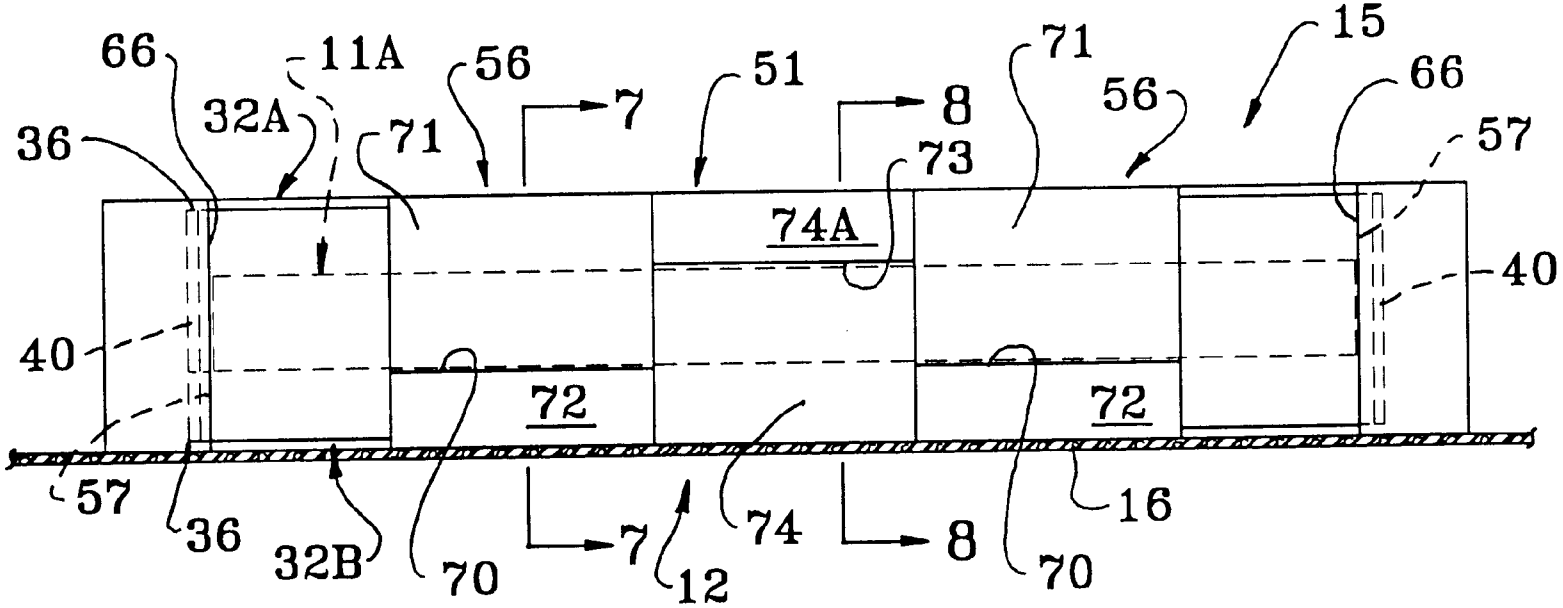
FIG. 4 is an enlarged, fragmentary cross-sectional view taken generally along line 4—4 in FIG. 2.
Figure 5:
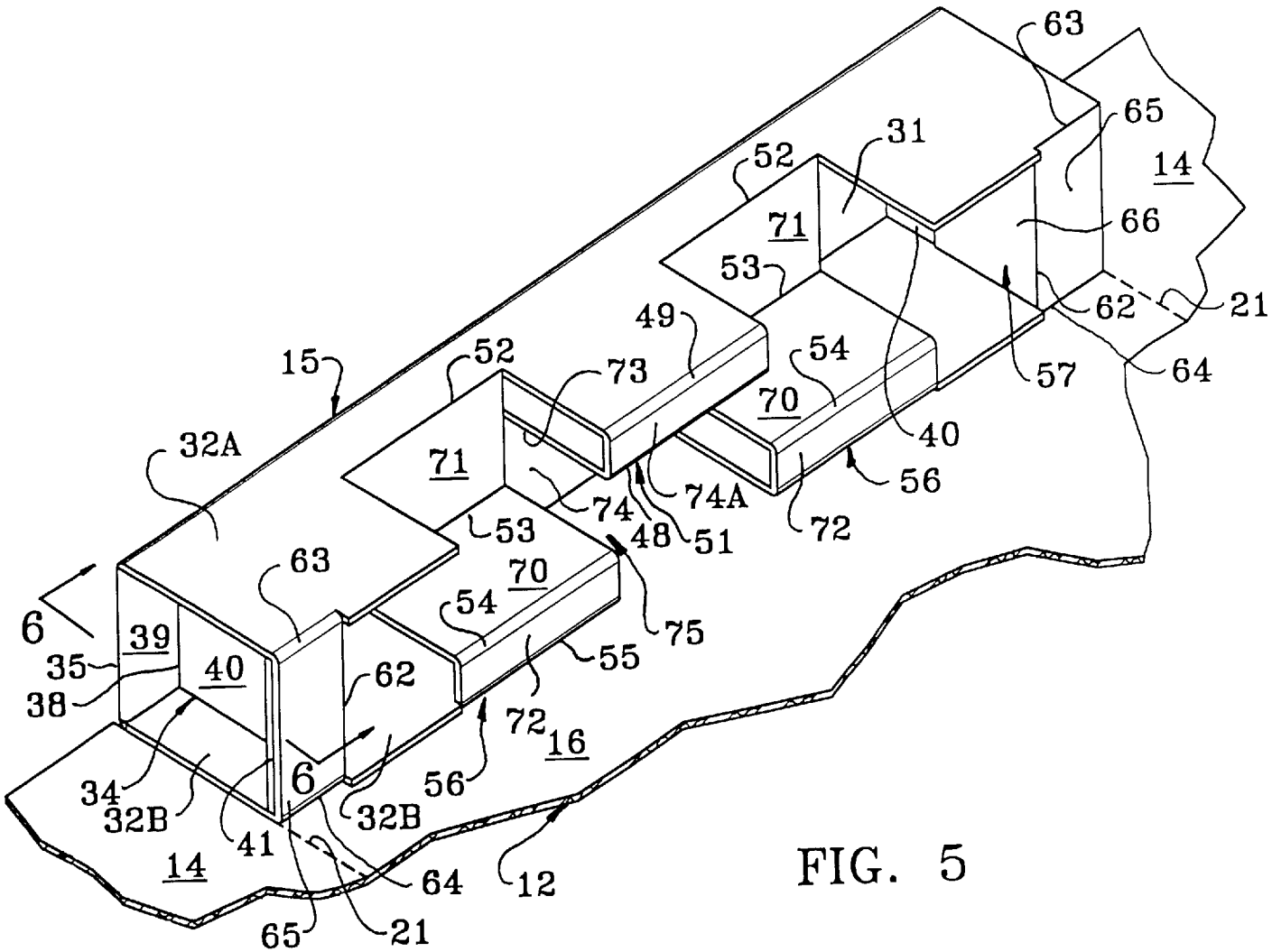
FIG. 5 is an enlarged fragmentary perspective view of one tubular side wall in an assembled configuration, the opposite tubular side wall being a mirror image thereof.

The respective terminal ends of each outer cut line 45 and the adjacent central cut line 44 located near fold line 33 are joined through a fold line 52 which extends perpendicularly between cut lines 44 and 45 and is parallel to and spaced outwardly from fold line 33. Additional fold lines 53, 54 and 55 extend between the respective pairs of central and outer cut lines 44 and 45. Fold lines 53–55 are spaced from and parallel to one another and to fold line 52. Further, fold lines 55 are longitudinally aligned with one another and with fold line 47, as is the case with fold lines 53 and fold line 49. Fold lines 52 are also longitudinally aligned with one another. When side wall 15 is folded, the outer cut lines 45 and the respective adjacent central cut lines 44 together with fold lines 52–55 cooperate to define endmost cavity defining supports 56 (FIGS. 4 and 5). Supports 56 are located on opposite ends of central support 51.

Each second side wall part 32 also includes a flap 57 located adjacent each outer cut line 45. Each flap 57 is defined by an inner free edge 58 defined by the respective cut line 45, and a pair of free side edges 59 defined by cut lines which are perpendicular to free edge 58. Further, inner free side edge 59 of each flap 57 is generally longitudinally aligned with fold lines 53 and 49, and outer free side edge 59 of each flap 57 is generally longitudinally aligned with fold lines 55 and 47. A fold line 62 extends transversely between the respective free side edges 59 and is parallel to and spaced outwardly from the respective outer cut line 45, and an additional pair of parallel fold lines 63 and 64 extend from opposite ends of fold line 62 to the respective free side edge 43 of second side wall part 32 and are perpendicular relative thereto. Fold line 62 separates the respective flap 57 from an end wall section 65 located outwardly thereof.

The blank 10 will normally be maintained in the flat condition illustrated by FIG. 1, which facilitates compact shipping and storage thereof. The blank 10 may be stamped or die cut from a large sheet of corrugated cardboard so as to result in the formation of a one-piece blank as illustrated by FIG. 1, and minor assembly steps are then required to permit enclosure of an object therein. These assembly steps will now be briefly described to ensure a complete understanding of the invention. Starting with the blank 10 in the flat condition shown in FIG. 1, each of the side walls 15 are folded to form a generally tubular configuration as follows. First side wall part 31 of one side wall 15 is folded upwardly about fold line 20 to vertically orient first side wall part 31, and second side wall part 32 is thereafter folded inwardly about fold line 33. Second side wall part 32 is then folded along longitudinally aligned fold lines 64, 55 and 47 and also along longitudinally aligned fold lines 63, 53 and 49. Free edge 42 of second side wall part 32 is tucked against first side wall part 31 so as to lie along fold line 20 and place the respective side wall 15 in an elongate tubular configuration having a generally rectangular transverse cross-section. The folding of second side wall part 32 in the above manner results in the formation of longitudinal sections 32A and 32B of second side wall part 32, which sections 32A, 32B are disposed in vertically-spaced juxtaposed relation with one another with lower section 32B being positioned atop and flat against bottom wall 16 (FIG. 5).

Thereafter, the respective flaps 57 located at opposite ends of the tubular side wall 15 are folded inwardly about the respective fold lines 62 so that flaps 57 are oriented generally perpendicular relative to the corresponding and now upright end wall sections 65. The flaps 57 are now vertically oriented with the respective upper and lower edges thereof defined by cut lines 59 lying along the respective upper and lower longitudinal sections 32A and 32B of second side wall part 32. Once flaps 57 are folded, the inwardly facing sides thereof define respective vertical object-supporting surfaces 66 for a purpose as discussed below.

Figure 6:
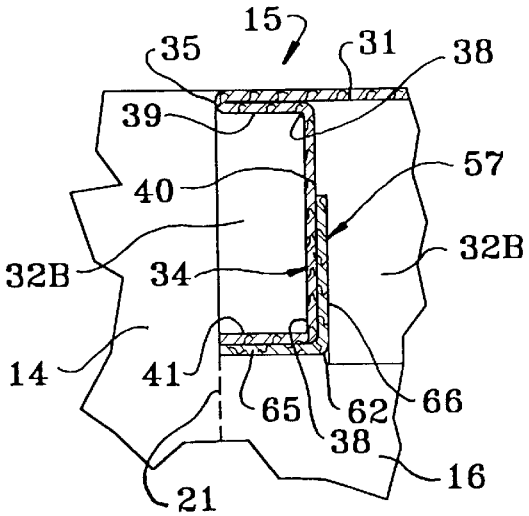
FIG. 6 is an enlarged cross-sectional view taken generally along line 6—6 in FIG. 5.

While maintaining the tubular side wall 15 in a position so that the free edge 42 of second side wall part 32 lies along fold line 20, the reinforcing end flaps 34 (which are presently vertically oriented due to the upright positioning of the corresponding first side wall part 31) are each folded inwardly about the respective fold line 35, and then inwardly along fold lines 38, and the entire flap 34 is pushed into the adjacent open end of the tubular side wall 15 so that the inner section 39 of flap 34 lies against the inwardly facing surface of first side wall part 31, the outer section 41 lies against the inwardly facing surface of the adjacent end wall section 65, and the intermediate section 40 lies against the outwardly facing surface of flap 57 opposite surface 66 (FIGS. 5 and 6). The upper and lower free edges 36 of the now vertically oriented intermediate section 40 lie along the respective upper and lower longitudinal sections 32A and 32B of second side wall part 32. In the illustrated embodiment, the reinforcing end flaps 34 completely close off the respective ends of tubular side wall 15 and assist in maintaining same in its folded tubular configuration.

Figure 7:
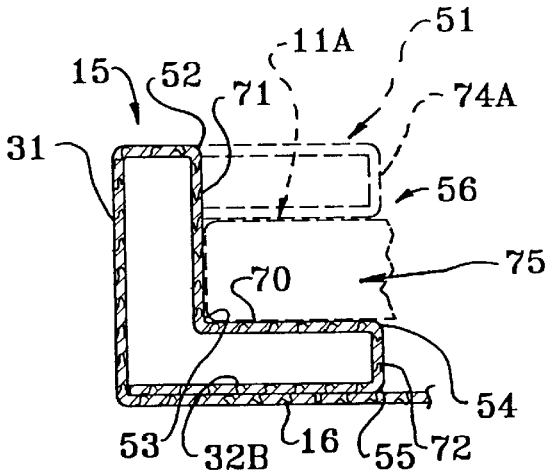
FIG. 7 is an enlarged cross-sectional view taken generally along line 7—7 in FIG. 4.
Figure 8:
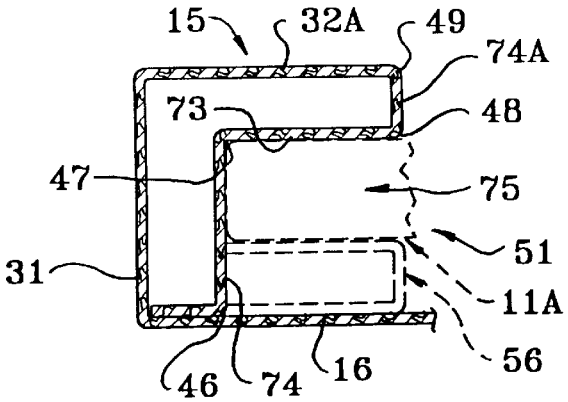
FIG. 8 is an enlarged cross-sectional view taken generally along line 8—8 in FIG. 4.

The tubular side wall 15 is then folded to define cavity defining supports 51 and 56 as follows. Each of the endmost cavity defining supports 56 are formed by applying pressure to the second side wall part 32 in a direction generally toward bottom wall 16 along the respective fold line 53 which causes second side wall part 32 to crease along fold lines 52 and 54 and "pop" inwardly, resulting in an L-shaped configuration as shown in FIGS. 5 and 7. This L-shaped configuration of support 56 defines respective horizontal and vertical and generally planar support surfaces 70 and 71. Horizontal support surface 70 is spaced upwardly from bottom wall 16 by a vertically extending bottom wall 72 of support 56 defined between fold lines 54 and 55. Central cavity defining support 51 is formed by applying upward pressure to second side wall part 32 along fold line 47, causing side wall part 32 to crease along fold lines 46 and 48, resulting in an inverted L-shaped configuration (see FIGS. 5 and 8) defining horizontal and vertical planar support surfaces 73 and 74. Horizontal support surface 73 is spaced downwardly from section 32A by a vertically extending upper wall 74A of support 51 defined between fold lines 48 and 49. Further, horizontal support surface 73 of central support 51 is parallel to and spaced upwardly from the respective horizontal support surfaces 70 of endmost supports 56 and is also horizontally offset relative thereto. As shown in FIGS. 4 and 6–8, the end surfaces 66 of flaps 57 along with support surfaces 70 and 71 of endmost supports 56, and along with support surfaces 73 and 74 of central support 51, define an elongate sidewardly opening channel 75 for receiving the edge of object 11A (shown in dotted lines in FIGS. 2, 4 and 6–8), such as a framed or unframed picture, or other fragile and generally flat object.

With one side wall 15 folded as described above, a terminal edge of the object or picture 11A is then inserted into channel 75 while the opposite side wall 15 is folded in the same manner as described above so as to form a tubular configuration defining a pair of endmost cavity defining supports 56 and a central cavity defining support 51 disposed therebetween. During folding of the second or opposite side wall 15, it may be necessary to position the object 11A in an angled or tilted orientation relative to bottom wall 16 so as not to interfere with the folding of portions of the second side wall 15, and then as the side wall 15 is folded to define the supports 51 and 56, the raised terminal edge of the object 11A (i.e. the terminal edge of the object 11A opposite the edge inserted within channel 75) can then be pivoted or lowered into the second channel 75. During this insertion of the object edge into the second channel 75, it may be necessary to slightly tilt or pivot the corresponding second tubular side wall 15 upwardly about the respective fold line 20 so as to allow easier insertion of the object edge into channel 75.

After assembly of side walls 15 as discussed above, the channels 75 defined thereby open sidewardly and inwardly toward one another so as to define a generally horizontally oriented and rectangular pocket or cavity within container 11 for receiving the object 11A.

With the opposite terminal edges of the object or picture 11A inserted into the respective opposed channels 75 as discussed above, the object 11A is supported in upwardly spaced relation from bottom wall 16 via the horizontal support surfaces 70 of the respective endmost supports 56. Side walls 14 are then folded upwardly about the respective fold lines 21 and then inwardly about the respective fold lines 26, so that the free side edges 25 of the respective top wall flaps 23 are disposed in opposed relation with one another. Adhesive tape or other fasteners can then be applied to the seam defined between edges 25 so as to completely enclose the object 11A within the container or box 11. It will be appreciated that top part 13 may be of a single-flap construction joined to one of side walls 14, if desirable. Further, the top part 13 may be provided with integral tabs or other locking features for closing the container 11 so as to avoid the necessity for adhesive tape.

It will be appreciated that while the above-described sequence of assembly steps is the preferred assembly sequence, same may be modified, for example, depending upon the particular object being packaged and also upon the configuration of the work area where the container is assembled. In addition, instead of inserting one edge of the object 11A into channel 75 of a folded side wall 15 and then folding the opposite side wall 15 as discussed above, it is possible to fold both side walls 15 into their tubular configurations and to define the respective supports 51 and 56, and then pivot or tilt each of the tubular side walls 15 slightly upwardly about their respective fold lines 20 to allow insertion of the object edges within the respective channels 75. Once the object 11A is positioned within the channels 75, the tubular side walls 15 are then pivoted downwardly so as to lie along bottom wall 16.

The configuration of the respective side walls 15 as disclosed herein supports the object 11A centrally within the container 11 in spaced relation from all external sides thereof, which provides an air space along all sides of the object 11A to cushion against impact loads. More specifically, the end surfaces 66 of the respective flaps 57 space the object horizontally inwardly from the respective upright side walls 14, the vertical surfaces 71 and 74 of supports 56 and 51 space the object horizontally inwardly from the respective upright side walls 31, the horizontal lower surfaces 70 of the endmost supports 56 space the object upwardly from bottom wall 16, and horizontal surface 73 of central support 51 spaces the object downwardly from top wall flaps 23.

The construction of the container 11 from a one-piece blank is advantageous as same eliminates the need for separate inserts or fillers, such as bubble wrap or plastic foam inserts. However, if desirable or necessary, for example to increase load capacity, the open cavities defined within the side walls 15 can be filled with foam or other cushioning materials. Further, the opposed cavity defining supports 51 and 56 are each formed from a single side wall 15 or flap structure, as compared to conventional packages which require folding of multiple flaps to form the cushioning arrangement which supports one side of the article.

While the formation of the container 11 from a one-piece blank is advantageous as discussed above, it is also possible to manufacture the tubular side walls 15 as separate components which can be filled with foam and installed on the edges of heavy articles, such as doors, windows, etc. The entire article can then be enclosed within a separate box or wrapper.

It will be appreciated that while the reinforcing flaps 34 help to hold the respective side walls 15 in the tubular configuration and also provide same with added rigidity, the flaps 57 may alone be sufficient to reinforce side wall 15 while simultaneously forming the object-supporting end surfaces 66 for spacing the object inwardly of the respective side wall 14.

It will also be appreciated that the side walls 15, once folded into the tubular configuration as discussed above, will retain their folded configuration, particularly after the object 11A is inserted into the container 11. However, it may be desirable to additionally secure side walls 15 (once folded) relative to bottom wall 16 with adhesive tape.

It will be understood that terms such as "horizontal" and "vertical" herein are used for convenience to describe the container when oriented horizontally as in the drawings. However, it will be appreciated that the container may be assembled in any orientation convenient to the assembler. Further, once the object 11A is enclosed within the container, same may be stored or transported with either of the bottom part 12 or top part 13 disposed uppermost.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A one-piece container constructed entirely from a one-piece blank of sheet-like corrugated material, said container comprising:

a horizontally enlarged and generally planar bottom wall having a first pair of generally parallel side edges and a second pair of generally parallel side edges extending generally perpendicularly relative to said first side edges;

first and second elongate and upright side walls folded upwardly from said bottom wall about generally horizontal fold lines which extend along the respective said first side edges;

a horizontally enlarged and generally planar top wall integrally joined to at least one of said first and second side walls and pivotable with respect thereto between open and closed positions; and third and fourth elongate side wall structures disposed in opposed spaced-apart relation with one another and extending transversely with respect to said first and second side walls, each said third and fourth side wall structure being formed in its entirety by a single flap integrally joined to said bottom wall and folded upwardly therefrom about a generally horizontal fold line which extends along one of said second side edges, each said flap being foldable to define an outer wall which forms part of the external surface of said container, each said third and fourth side wall structure including a first support member defining a first support surface thereon which faces upwardly and projects sidewardly and inwardly away from the respective said outer wall and a second support surface which projects upwardly from one edge of said first support surface and is disposed adjacent but spaced horizontally inwardly from the respective said outer wall, and a second support member disposed adjacent said first support member and defining a third support surface which faces downwardly and projects sidewardly and inwardly away from the respective said outer wall and a fourth support surface which projects downwardly from one edge of said third support surface and is disposed adjacent but spaced horizontally inwardly from the respective said outer wall, said support surfaces of each said third and fourth side wall structure together defining a channel which opens generally sidewardly and inwardly, said channels of the opposed third and fourth side wall structures together defining a pocket for receiving a generally plate-like article therein, said first and third support surfaces being disposed in vertically spaced relation with one another to sandwich the article therebetween and maintain the article in vertically spaced relation from said top and bottom walls, said second and fourth support surfaces engaging a side edge of the article and spacing same horizontally from the respective outer wall to prevent damage to the article during storage or transport thereof.

2. The container of claim 1 wherein opposite terminal edges of the plate-like article are disposed within the respective channels, and said third and fourth side wall structures are tubular in configuration and define respective air cushions around upper, lower and side surfaces of the edges of the article disposed within the respective channels to protect same against impact.

3. The container of claim 1 wherein said third and fourth side wall structures each include a third support member identical to said first support member, said first and third support members each having an L-shaped transverse cross-section so as to define said first and second support surfaces thereon respectively disposed in generally horizontal and vertical orientations, said second support member being disposed between said first and third support members and having an inverted L-shaped transverse cross-section so as to define said third and fourth support surfaces thereon, said fourth support surface being oriented generally vertically and in coplanar relation with said second support surfaces of said first and third support members, and said third support surface being oriented generally horizontally and in vertically spaced relation with said first support surfaces of said first and third support members.

4. The container of claim 3 wherein said third and fourth side wall structures each include a pair of end walls disposed at respective opposite ends thereof with said first, second and third support members being disposed therebetween, each said end wall defining a support surface thereon which is vertically oriented and extends generally perpendicularly relative to said second and fourth support surfaces of the respective said first, second and third support members, said vertical support surfaces of the respective said end walls being disposed in opposed horizontally spaced relation with one another and maintaining the article in horizontally spaced relation with said first and second side walls.

5. The container of claim 4 wherein said first support surfaces of said first and third support members are vertically spaced from said third support surface of said second support member and engage a first generally horizontally enlarged side of the article, said third support surface of said second support member engaging a second generally horizontally enlarged side of the article facing away from the first side thereof, said second and fourth support surfaces of said first, second and third support members of each said side wall structure engaging respective third and fourth generally vertically oriented sides of the article extending transversely between the first and second sides thereof, and said vertical support surfaces of said end walls of each said side wall structure engaging respective fifth and sixth generally vertically oriented opposite sides of the article extending transversely between the first and second sides thereof and oriented generally perpendicular to the third and fourth sides thereof.

6. The container of claim 1 wherein said third and fourth side wall structures each define a pair of end walls formed by respective end flaps each of which defines a further support surface thereon, said first and second support members being disposed between the respective pair of said end walls, and said support surfaces of said end walls being oriented vertically and engaging a further side edge of the article and spacing same horizontally inwardly from the respective said first and second side wall.

7. The container of claim 1 wherein said outer wall of each said flap is joined to said bottom wall along one said second side edge thereof, said outer wall projecting upwardly from said bottom wall and being oriented generally perpendicular relative thereto, each said flap including a flap part which defines said support members and said support surfaces thereof and which is joined to and folded inwardly along an upper longitudinal edge of the respective said outer wall, said outer wall and said flap part together providing the respective said side wall structure with an elongate tubular configuration having a pair of open opposite ends, and each said flap part defining a pair of end flaps which are foldable inwardly into the respective open ends of said side wall structure to substantially close off same.

8. The container of claim 7 wherein said support members are disposed between the respective pair of end flaps and said end flaps each define a support surface thereon, said first and third support surfaces being disposed to respectively engage oppositely facing upper and lower side surfaces of the article to space same vertically from the respective top and bottom walls and said second and fourth support surfaces being disposed to engage a side edge of the article extending transversely between the upper and lower side surfaces thereof to space the article horizontally inwardly from the respective said outer wall, and said support surfaces of said end flaps being disposed to engage respective oppositely facing end edges of the article and space same inwardly from the respective said first and second side wall.

9. The container of claim 8 wherein a pair of reinforcing flaps are joined to respective upright side edges of each said outer wall, said reinforcing flaps being foldable inwardly so as to be respectively positioned within the open ends of said side wall structure in overlapping relation with the respective said end flaps to reinforce said side wall structure and assist in maintaining same in said tubular configuration.

10. The container of claim 1 wherein said top wall includes a pair of top flaps respectively joined to upper edges of said first and second side walls, said top flaps being foldable inwardly from the respective said side wall so as to be positioned in vertically spaced and generally parallel relation with said bottom wall, and said top flaps having respective terminal longitudinal edges which are parallel to and disposed closely adjacent one another so as to close off an interior of said container in said closed position.

11. A box constructed entirely of corrugated material, said box comprising:

a generally planar bottom wall having a pair of generally parallel first side edges and a pair of generally parallel second side edges extending transversely relative to said first side edges;

first and second elongate and opposed side walls folded upwardly from said bottom wall generally along the respective said first side edges thereof;

third and fourth elongate and opposed end walls extending transversely relative to said first and second side walls and folded upwardly from said bottom wall generally along the respective said second side edges thereof;

a top wall disposed in generally parallel relation with said bottom wall and being spaced upwardly therefrom by said side and end walls, said top wall being joined to one of said side and end walls and swingably movable relative thereto between open and closed positions;

said box having a width dimension as defined between either pair of the opposed side and end walls which is significantly greater than a depth dimension as defined between said top and bottom walls so as to accommodate a generally planar, plate-like object therein; and a pair of elongate support structures respectively positioned along the pair of opposed end walls in spaced-apart relation with one another, each said support structure including a generally vertically oriented wall generally parallel with the respective end wall and spaced inwardly therefrom to define an air pocket therebetween, and a pair of generally horizontally oriented and vertically spaced wall structures which extend inwardly beyond said vertical wall and define respective air pockets therein, said vertical wall and said wall structures of each said support structure together defining a channel, said channels opening inwardly towards one another for receiving therein opposite terminal edges of the object, said vertical wall and said wall structures of each said support structure together defining an air cushion which surrounds the edge of the object disposed within the respective channel.

12. The box of claim 11 wherein said wall structures respectively define vertically spaced object-supporting surfaces which are generally planar and horizontally oriented and sandwich a terminal edge of the object therebetween, said object-supporting surfaces being vertically spaced from the respective said top and bottom walls.

13. The box of claim 12 wherein said walls of the respective support structures each define a generally planar and vertically oriented object-supporting surface which extends transversely relative to said horizontal object-supporting surfaces and is spaced horizontally inwardly of the respective said end wall.

14. The box of claim 13 wherein said support structures each define a pair of object-supporting end surfaces disposed at respective opposite ends thereof, said object-supporting end surfaces extending transversely relative to the respective horizontal and vertical object-supporting surfaces and being spaced horizontally inwardly of the respective said side walls, said horizontal and vertical object-supporting surfaces and said object-supporting end surfaces spacing the object inwardly of said top, bottom, side and end walls.

15. The box of claim 11 wherein said box is constructed from a one-piece blank of corrugated material and each said support structure and the respective said end wall are formed from a single flap which is integrally joined to said bottom wall along a said second side edge thereof.

16. The box of claim 15 wherein said top wall includes a pair of top flaps which are respectively joined to said first and second side walls along upper edges thereof, each said flap being pivotably movable between an open position to provide access to an interior of said box and a closed position wherein inner free edges of said top flaps are disposed in closely adjacent and opposed relation with one another to close off the interior.

17. The box of claim 11 wherein each of said wall structures are defined by a pair of vertically spaced, horizontally oriented and planar wall parts which project sidewardly and inwardly away from the respective end wall and are connected to one another by an inwardly disposed and generally vertically oriented end wall part joined to the respective wall parts through respective fold lines, said wall parts and said end wall part together defining a hollow air-filled interior for cushioning the object.

* * * * *